United States Patent [19]

Ainsworth

[11] 4,188,997

[45] Feb. 19, 1980

[54] WELL PUMP SERVICE

[76] Inventor: Ross N. Ainsworth, Ranch Route, Milnesand, N. Mex. 88125

[21] Appl. No.: 966,095

[22] Filed: Dec. 4, 1978

[51] Int. Cl.[2] ..... E21B 19/08

[52] U.S. Cl. ..... 166/77; 254/186 R; 254/190 R; 254/186 HC

[58] Field of Search ..... 166/75 R, 75 A, 77; 254/186 R, 186 HC, 134, 3 FT, 134.3 PA, 140 R, 187 A

[56] References Cited

U.S. PATENT DOCUMENTS

| | | | |
|---|---|---|---|
| 1,890,159 | 12/1932 | McConahay | 254/186 HC |
| 2,670,926 | 3/1954 | Sewell et al. | 254/190 R |
| 2,695,684 | 11/1954 | Robertson | 254/186 HC |
| 2,798,435 | 9/1957 | Armstrong | 254/181 R |
| 2,810,440 | 10/1957 | Kenneday et al. | 166/77 |
| 3,116,781 | 1/1964 | Rugeley et al. | 166/77 |
| 3,291,449 | 12/1966 | Hughes | 254/134.3 FT |
| 3,524,606 | 8/1970 | Coski | 254/186 |
| 3,589,642 | 6/1971 | Blagg | 254/190 R |
| 4,006,884 | 2/1977 | Lederhos et al. | 254/134.3 PA |

*Primary Examiner*—William F. Pate, III
*Attorney, Agent, or Firm*—Wendell Coffee

[57] ABSTRACT

A pair of side members are placed on either side of a well. The side members are connected by an axle running through a top of the side members with a sheave between them. A flexible pipe such as used to suspend a submersible pump may be pulled from the well by connecting the flexible pipe to a pickup and driving the pickup away from the well. A cable may be pulled from the well by attaching it to a windlass drum and winding it upon the windlass drum adjacent to the sheave. A jiggler may be placed between the windlass drum and sheave to jiggle the cable as desired.

1 Claim, 5 Drawing Figures

Fig. 1
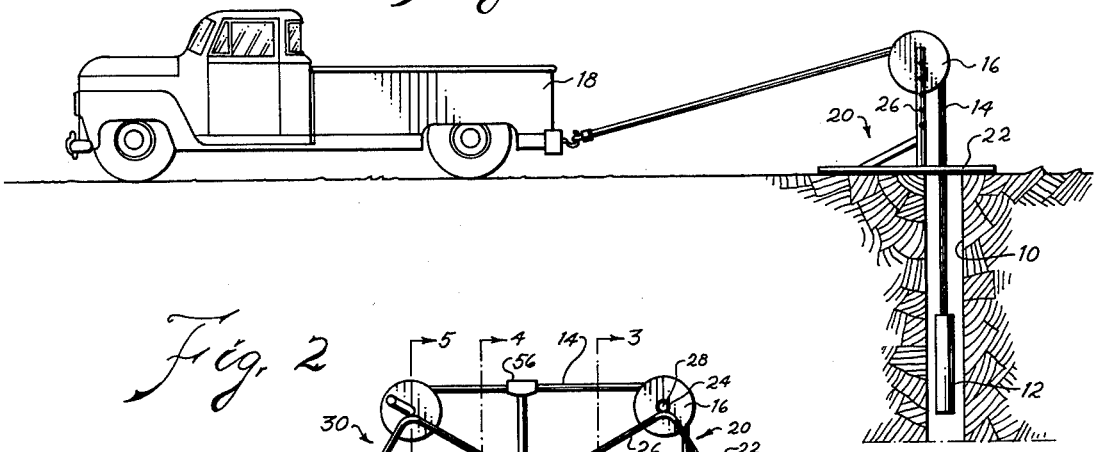
Fig. 2
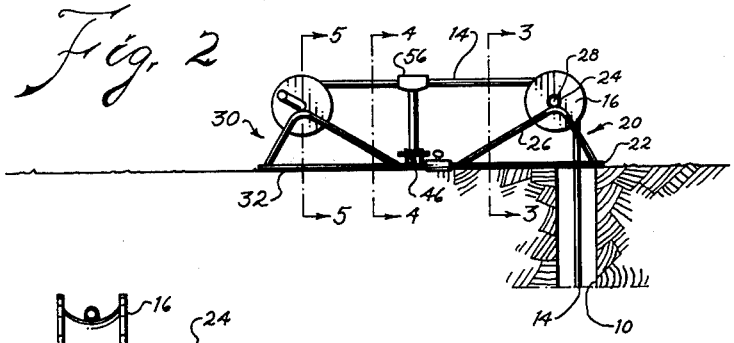
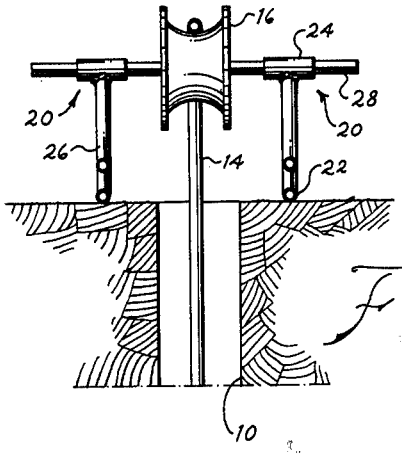
Fig. 3
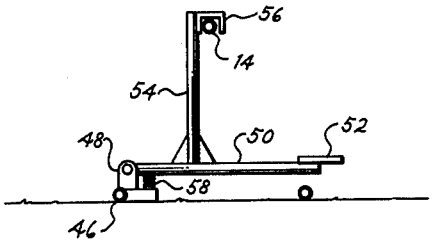
Fig. 4
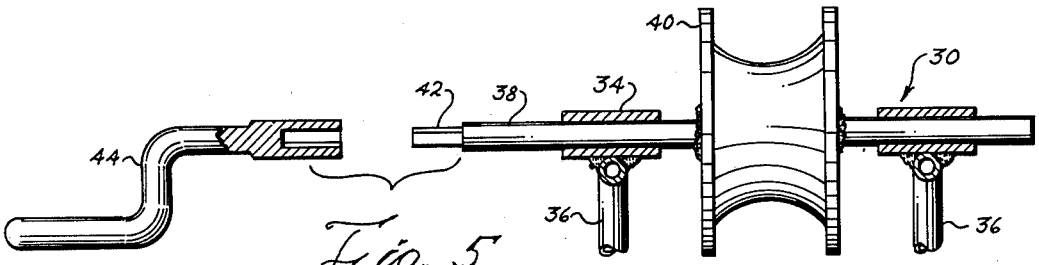
Fig. 5

WELL PUMP SERVICE

BACKGROUND OF THE INVENTION (1) Field of the Invention

This invention relates to pulling flexible pipe, cables and the like from wells and more particularly relates to portable derrick hoists therefor.

(2) Description of the Prior Art

Pulling tools or pumps from wells has always presented a problem. Sometimes previously, a permanent derrick is constructed over the well for this purpose. In the western United States for domestic water wells the windmill tower formed this derrick for pulling the pipe or sucker rod from the well.

At other times, a portable tower or derricks in the form of being completely truck mounted have been used.

In recent years, a more and more flexible material has been used in wells. Particularly in domestic water wells, many of the pumps are self-contained submergible pumps which include not only the pump but an electric motor to drive the pump which are located in the bottom of the well attached to a bottom of a flexible pipe. This flexible pipe may be plastic hose or tube with an electric cable strapped to it.

In addition, in the normal service of a well it is often necessary to run cables in the well. These cables sometimes have balers attached to them or have grabs or grapplers or other tools to fish loose material from the well.

Before this application was filed, the applicant caused a search to be made in the United States Patent and Trademark Office. The following patents were found as a result of that search.

U.S. Pat. No. 158,434; Newcomb
U.S. Pat. No. 656,079; Arsnean
U.S. Pat. No. 772,994; Wood
U.S. Pat. No. 932,444; Chambers
U.S. Pat. No. 1,103,823; Padgett
U.S. Pat. No. 1,789,025; Shepard
U.S. Pat. No. 2,222,243; Sandstrom
U.S. Pat. No. 2,643,856; Sales
U.S. Pat. No. 2,648,521; Sales
U.S. Pat. No. 2,676,677; Anderson
U.S. Pat. No. 2,941,634; Hanks
U.S. Pat. No. 2,985,430; Greenwood
U.S. Pat. No. 3,498,472; Rodgers
U.S. Pat. No. 3,991,978; Jones CHAMBERS discloses a stump puller having a differential hoist. A draft animal is attached to the cable to pull the stump.

NEWCOMB discloses a scaffold over a well with a pulley at the top of the scaffold.

JONES discloses a mast or boom which is attached to to the top of the casing. He then attaches the cable and the winch 29 to raise material from the well.

GREENWOOD discloses a hoist on a well which has telescoping legs.

The remaining patents do not appear to be any more pertinent to this invention than the ones discussed above.

SUMMARY OF THE INVENTION

New and Different Functions

Often wells are located at remote locations. Therefore, it is desirable that highly portable equipment be used in the servicing of these wells. Also, it is always desirable to have as inexpensive equipment as possible to service the wells. I have developed highly portable equipment which can be moved readily to remote locations, quickly assembled and used to service wells. The equipment can be easily transported and carried in a small pickup truck.

Specifically, the equipment uses a simple framework which can be very easily disassembled or reassembled to be placed over the well providing the basic support for a sheave over the top of the well. The framework is quickly adjustable so that if a firm support cannot be found adjacent to the well the support can be widened. Also, if firm support in the nature of a concrete block at the surface of the well is available, the framework can be contracted so that it will fit upon this support. In some instances, it is most desirable to connect the flexible material by means of a rope or cable to the pickup itself and then drive the pickup away to pull the material from the well. In other instances, it is more desirable to attach the flexible material to a windlass and pull it be cranking the windlass.

Often times, materials tend to get stuck in a well. Such cases it is desirable to jar or jiggle the supporting cable or pipe. Also, in certain cases to clean out a certain amount of material in the bottom of the well it is desirable that the equipment on the bottom be drilled or jiggled. For this purpose, I have provided for a jiggler to be located and to operate upon the cable between the well sheave and the windlass drum.

Therefore, it may be seen that the total function of my invention far exceeds the sum of the function of the individual elements such as the sheaves, axles, draft vehicles, etc.

Objects of This Invention

An object of this invention is to remove and place objects attached to a flexible tension element in a well.

Further objects are to achieve the above with a device that is sturdy, compact, durable, lightweight, simple, safe, efficient, versatile, ecologically compatible, energy conserving, and reliable, yet inexpensive and easy to manufacture, assemble, operate, disassemble and maintain.

Other objects are to achieve the above with a method that is versatile, ecologically compatible, energy conserving, rapid, efficient, and inexpensive, and does not require skilled people to assemble, operate, disassemble and maintain.

The specific nature of the invention, as well as other objects, uses, and advantages thereof, will clearly appear from the following description and from the accompanying drawing, the different views of which are not scale drawings.

BRIEF DESCRIPTION OF THE DRAWINGS

FIG. 1 is a side elevational view of one embodiment of my invention showing flexible tension element pulled from the well by a draft vehicle.

FIG. 2 is a side elevational view of a second embodiment of my invention showing a windlass drum and jiggler with a well sheave.

FIG. 3 is a sectional view, taken substantially on line 3—3 of FIG. 2.

FIG. 4 is a sectional view showing the jiggler, taken substantially on line 4—4 of FIG. 2.

FIG. 5 is a sectional view through the windlass drum, taken substantially on line 5—5 of FIG. 2.

DESCRIPTION OF THE PREFERRED EMBODIMENTS

Referring to FIG. 1 there may be seen somewhat schematically a first embodiment of this invention. The invention is to be used with a well which will include a bore 10 deep within the earth. The well also includes a piece of downhole equipment 12. For brevity, this piece of downhole equipment will be referred to as pump 12, however, those skilled in the art will understand that the piece of downhole equipment could be any number of objects such as a baler, a drill bit, a grab or any other tool or object desired to be lowered into or removed from the well. According to this invention, pump 12 would be suspended from flexible tension element 14. In the case of the submergible pump, the flexible tension element would be the flexible pipe itself which is attached to the pump 12 together with the associated electrical cables strapped thereto. In the event of the baler the flexible tension element would be in the form of cable.

For use according to this invention, a portable derrick or support member would be mounted over the bore 10 and well sheave 16 journalled over the bore. Then, the flexible tension element 14 would be attached to a draft vehicle in the form of pickup truck 18. This attachment could either be by attaching the flexible tension element itself to the truck, however, more conveniently a rope would be used to be tied to the truck and the rope spliced or bend to the flexible tension element. Then the pickup 18 is driven away from the well thereby pulling the pump 12 from the well. Of course, to lower the pump into the well, the procedure is reversed.

Of course, to suspend the well sheave 16 over the well some equipment is used. This invention contemplates that it would be suspended by portable equipment. This portable equipment would include a pair of well side members 20. These well side members are conveniently provided in the form of A-frames or triangular frames made of tubular material. Each of the frames would include ground runner 22 which would in use rest upon the surface of the earth adjacent to the well. At the angle opposite the ground runner there is attached elongated tube 24. The elongated tube is at right angles to the plane having the triangle member. It would be understood that the device could take other forms. In any event, the side member would have the ground runner 22 resting upon the surface of the earth, the elongated tube 24 at the upper portion of them and some sort of frame members 26 interconnecting the runner and the tube. As stated above, in the preferred form the framing members are the tubular portions which complete the triangle.

Of course, the two side members 20 will not stand upright individually. When axle 28, in the form of a bar, is inserted through the elongated tubes 24 at the top of each of the side members 20, it does form a stable structure. It may be seen that the structure is adjustable as to width. I.e., the two side members 20 may be moved as close together as necessary as long as there is room between them for the width of the sheave 16 or they can be moved apart as wide as the length of the axle 28 will permit. For transportation when the axle 28, with the sheave 16 attached, is removed it will also be seen that they will all take very small volume to be placed within the truck to be brought to and from the well site.

The sheave 16 itself is a grooved pulley closely resembling a automobile wheel with the axle 28 placed in the center thereof.

As described in the embodiment of FIG. 1, the structure has utility in connection with the draft vehicle 18 for pulling flexible tension elements 14 from the well.

In connection with a windlass unit, it has additional utility. The windlass unit as seen in FIG. 2 includes two windlass side members 30 which are similar to the well side members 20. I.e., they have the ground runner 32 resting upon the surface of the earth with elongated tube 34 with frame members 36 interconnecting the tube above the ground at right angles to the runner. Windlass axle 38 is securely attached as by welding to windlass drum 40. One end of the windlass axle has non-round section 42 on it so that crank 44 may be fitted upon the windlass axle 38 after the axle has been assembled with the side members 30 for rotating the windlass drum 40 to wind up the flexible tension element 14 upon the windlass drum. It will be understood that it is necessary that the crank be detachably connected to the windlass axle, else the equipment cannot be readily disassemble for easy transport. Also, it will be seen when the windlass is set up that the well axle 28 and the windlass axle 38 will be parallel. Also, it may be seen that the flexible tension element 14 will extend from the well over the sheave 16 and to the windlass drum 40.

In many instances, it is desirable to jiggle the flexible tension element 14. I have provided a jiggler for this purpose.

For such use the two units are connected together with center coupling 46. This center coupling is provided with quick hand connections so that one of the well side members 20 is connected to one of the windlass side members 30. Hinge 48 is attached to one of the center coupling members 46. Since the two side members are connected together it is connected to both the windlass side member and to the well side member. Pedal arm 50 is pivoted to the hinge 48. The pedal arm will extend approximately parallel to the well axle 28 and the windlass axle 38. The pedal arm is hinged at one end has pedal 52 on the other end. Between the hinge and the pedal, pedal rod 54 is attached to the arm 50 and extends upward to above the flexible tension element 14. Channel or crook or hook 56 at the top of the pull rod 54 extends over the flexible tension element. Therefore, it may be seen that depressing the pedal 52 with the foot will pull downward against the flexible tension element. If the flexible tension element is taut between the windlass drum 40 and well sheave 16, pulling down upon it there will exert a great tension upon the element as it extends into the well. In this manner, the flexible tension element 14 can be jiggled. As stated before, this is extremely useful in the event an object is stuck in the well or it is desirable to pound on the bottom of the well or the like.

Spring 58 extends between the pedal arm 50 and one of the ground runners to hold the crook 56 at the top of the pull rod 54 away from the flexible tension element except when it is being pulled down by the pedal.

As an aid to correlating the terms of the claims to the exemplary drawing, the following catalog of elements is provided:

10 bore
12 pump
14 flexible tension element
16 well sheave
18 pickup
20 well side member
22 runner
24 tube
26 frame
28 axle
30 windlass side member
32 runner
34 tube
36 frame
38 axle
40 drum
42 non-round
44 crank
46 center coupling
48 hinge
50 pedal arm
52 pedal
54 pull rod
56 hook
58 spring It will be understood the windlass could be powered other than by a crank, e.g., by an electric or hydraulic motor for deep wells or large tubing. Also, the windlass would have a lock or brake, not shown in the drawing, for letting tools or down hole equipment fall freely into the wells and locking the windlass when the jiggler is used.

The embodiments shown and described above are only exemplary. I do not claim to have invented all the parts, elements or steps described. Various modifications can be made in the construction, material, arrangement, and operation, and still be within the scope of my invention. The limits of the invention and the bounds of the patent protection are measured by and defined in the following claims. The restrictive description and drawing of the specific example above do not point out what an infringement of this patent would be, but are to enable the reader to make and use the invention.

I claim as my invention:

1. In a well having a. a bore deep within the earth, and b. a flexible tension element extending from above the surface of the earth to deep within the bore, the improved structure for raising and lowering the flexible tension element comprising:

c. a pair of well side members each including:
   (i) a ground runner resting on the surface of the earth,
   (ii) an elongated tube,
   (iii) frame means innerconnecting the runner and tube for supporting the tube above the ground at right angles to the runner, d. a sheave, e. a well axle journalled through both of the tubes, and f. the sheave on the axle between the side members, g. the flexible tension element extended over the sheave, h. so that one side of the sheave is located over the bore and the flexible tension element extends straight into the bore, j. two windlass side members, similar to the well side members, k. a windlass drum, m. a windlass axle connected to the windlass drum and journalled through the tubes of the additional side members, and n. crank means detachably connected to the windlass axle for rotating the windlass drum, o. said additional side members adjacent said well side members with the well axle and windlass axle parallel, and p. said flexible tension element extending from the sheave to the windlass drum, q. a hinge between one of the well side members and one of the windlass side members, r. said hinge attached to each of the side members it is between, s. a pedal arm attached to the hinge at one end with t. a pedal on the other end, u. a pull rod attached to the pedal arm between the hinge and hinge, and v. a channel on top of the pull rod over the flexible tension element, w. so that depression of the pedal depresses the flexible tension element between the sheave and windlass drum.

* * * * *